United States Patent [19]

Shedd

[11] Patent Number: 4,759,779

[45] Date of Patent: Jul. 26, 1988

[54] SPACER MEANS FOR CROSS-LINKING COLLECTING ELECTRODE PANELS IN AN ELECTROSTATIC PRECIPITATOR

[75] Inventor: Keith P. Shedd, Birmingham, Ala.

[73] Assignee: Combustion Engineering, Inc., Windsor, Conn.

[21] Appl. No.: 42,909

[22] Filed: Apr. 27, 1987

[51] Int. Cl.[4] ..... B03C 3/08

[52] U.S. Cl. ..... 55/145; 52/562; 52/714; 55/156

[58] Field of Search ..... 55/143, 145, 154, 156, 55/130; 52/426, 562, 682, 712, 714

[56] References Cited

U.S. PATENT DOCUMENTS

| | | | |
|---|---|---|---|
| 1,013,038 | 12/1911 | Mitchell | 52/714 X |
| 1,465,812 | 8/1923 | Dunbar | 52/562 X |
| 1,833,875 | 11/1931 | Lockwood | 52/562 X |
| 1,911,626 | 5/1933 | Larzelere | 52/426 X |
| 2,596,526 | 5/1952 | Busfield | 55/156 X |
| 3,238,684 | 3/1966 | Wood | 52/426 X |
| 3,440,792 | 4/1969 | Schmidgall | 52/714 X |
| 4,007,023 | 2/1977 | Batza et al. | 55/143 X |
| 4,239,514 | 12/1980 | Junkers | 55/145 |
| 4,240,810 | 12/1980 | Frauenfelder | 55/156 X |
| 4,479,813 | 10/1984 | Jonelis | 55/145 X |
| 4,559,064 | 12/1985 | Ahern | 55/145 |
| 4,647,296 | 3/1987 | Tuck | 55/145 X |

FOREIGN PATENT DOCUMENTS

| | | | |
|---|---|---|---|
| 137221 | 1/1920 | United Kingdom | 52/426 |

*Primary Examiner*—Kathleen J. Prunner

*Attorney, Agent, or Firm*—William W. Habelt

[57] ABSTRACT

An integral one-piece spacer (70) is provided for use in an electrostatic precipitator (10) of the type having adjacent horizontally spaced collecting electrode panels (20) disposed in parallel relationship in spaced vertically extending planes. The spacer (70) extends transversely between adjacent collecting electrode panels (20) to rigidly link the panels so as to maintain the proper spacing therebetween. The spacer (70) is formed of an elongated rod having a rigid straight central portion (74) extending between a pair of spaced resilient end portions (72). The end portions (72) are folded to provide a clip (76) forming a slot (90) for attaching the end portions (72) of each spacer (70) to the legs (54) of the alignment brackets (50) mounted to the ends of the collecting electrode plates (22) to extend between a pair of neighboring collecting electrode panels (20).

3 Claims, 3 Drawing Sheets

SPACER MEANS FOR CROSS-LINKING COLLECTING ELECTRODE PANELS IN AN ELECTROSTATIC PRECIPITATOR

BACKGROUND OF THE INVENTION

The present invention relates to electrostatic precipitators and, more particularly, to a spacer for maintaining in spaced, parallel relationship a pair of segmented collecting electrode panels, each panel comprised of a plurality of aligned collecting electrode plates suspended from a support beam.

In the operation of an electrostatic precipitator, a gas laden with entrained particulate material will pass through an electrostatic field established about a discharge electrode assembly disposed intermediate to grounded collecting electrode panels. The suspended particles become electrically charged as they pass through the electrostatic field and move to, under the influence of the electrostatic field, and deposit upon the grounded collecting electrode panels flanking the discharge electrode assembly.

Although the prior art includes various collecting electrode panel designs, collecting electrode panels are commonly constructed in modular form by suspending a plurality of successively aligned collecting electrode plates in end to end relationship to form the collecting electrode panel. Each collecting electrode plate is typically suspended from a support beam mounted in the top of the precipitator housing to extend downwardly in a vertical plane. Each individual plate is formed of sheet metal and typically ranges from 1 to 3 feet in width and typically from 30 to 50 feet in length. The typical spacings between the collecting electrode panels are from 9 to 12 inches. One common configuration of collecting electrode plate is shown in U.S. Pat. No. 4,240,810. As disclosed therein, each panel includes a central flat plate web portion extending between spaced end portions which comprise J-shaped stiffening beams. Generally, alignment brackets are provided so as to extend between successive aligned plates as a means of loosely locking the plates of a panel in alignment. Typically, such brackets are U-shaped and disposed with the base of the U-shaped bracket mounted to the J-shaped stiffening beam at the end of one plate such that the legs of the U-shaped bracket extend outwardly to engage the end of the next successive plate within the cavity of the U-shaped alignment bracket.

The horizontal spacing between adjacent, parallel collecting electrode panels is critical and both panels should be maintained equally distant from the discharge electrodes extending in a parallel plane midway the collecting electrodes. If one collecting electrode panel, or any part thereof, is closer to the discharge electrodes than its neighboring panel on the opposite side of the discharge electrodes, arcing of the voltage between the discharge electrode and the closer of the spaced collecting electrodes will occur at a lower voltage than the peak operating voltage of the precipitator. Such arcing will limit the strength of the field attainable and also lower the operating efficiency of the precipitators.

In order to maintain neighboring collecting electrode panels in properly spaced relationship, it is common to use horizontally extending spacer bars or cross braces which are attached to the panels to extend horizontally between adjacent panels and provide the necessary strength and rigidity to maintain the desired spacing between the collecting electrode panels. To install such braces, it is usually necessary for a worker to enter the precipitator housing when the precipitator is not in operation to manually install the braces, typically by welding or bolting. Generally, such a process is labor intensive, expensive and time-consuming. Examples of various prior art spacers are disclosed in U.S. Pat. Nos. 3,553,939; 4,007,023; 4,478,614; 4,519,818; and 4,559,064.

Accordingly, it is an object of the present invention to provide a simple, inexpensive spacer which may be readily installed in a labor efficient manner at one or more positions along the vertical interface between successive aligned plates of neighboring panels.

SUMMARY OF THE INVENTION

The spacer of the present invention comprises a one-piece member having a pair of resilient end portions, a rigid longitudinally extending central portion, and clip means integrally formed in the end portions for attaching the end portions to the alignment brackets associated with the collecting electrode panels, thereby enabling the spacer to be readily installed without welding or bolting or the like so as to extend transversely between adjacent collecting electrodes.

BRIEF DESCRIPTION OF THE DRAWING

The present invention will be better understood and the above and other objects of the present invention will become more apparent and appreciated when viewed in light of the following description of a preferred embodiment with reference to the accompanying drawings, wherein.

DESCRIPTION OF THE PREFERRED EMBODIMENT

Figure 1:
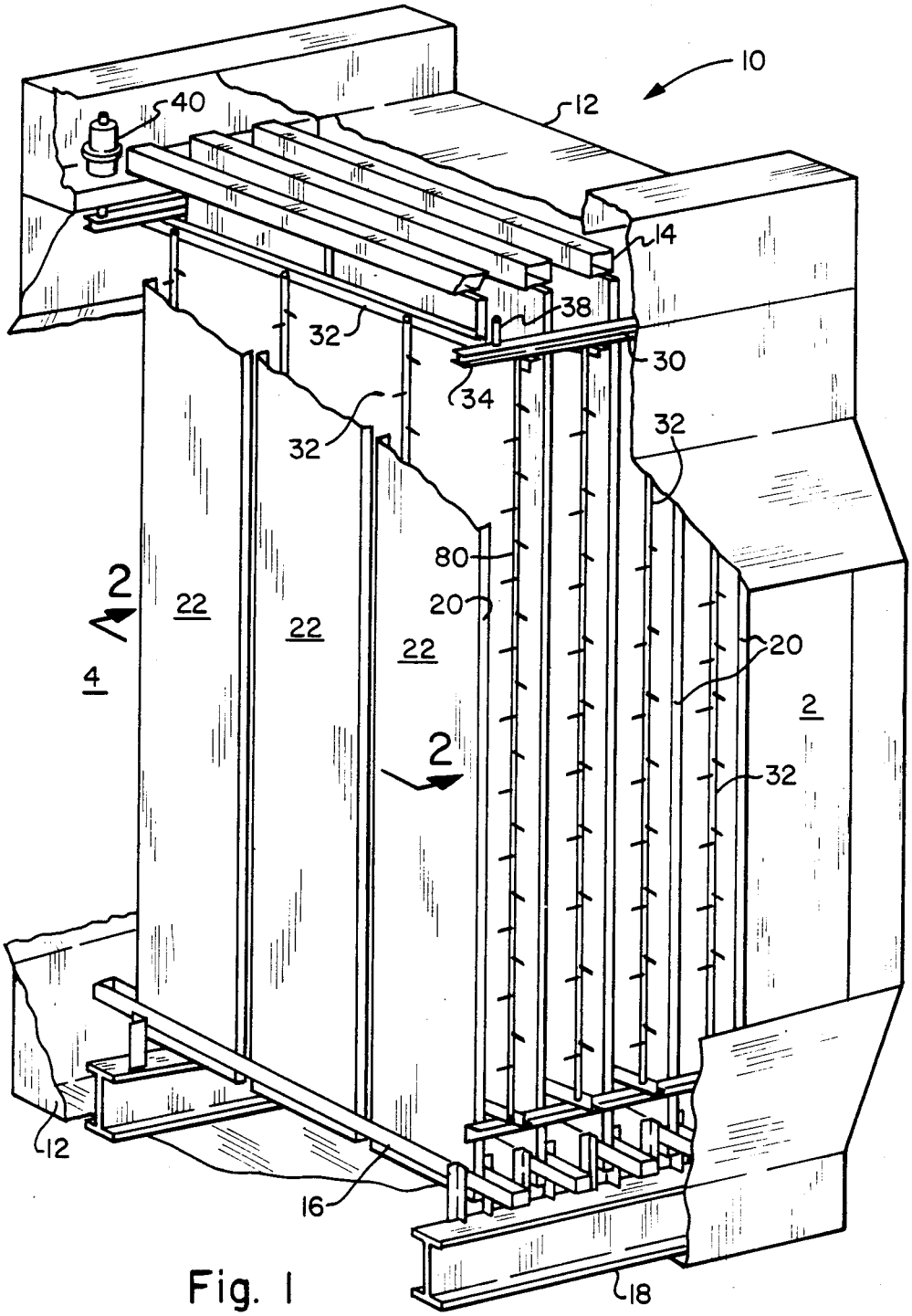
FIG. 1 is a perspective view, partly in section, of an electrostatic precipitator.
Figure 2:
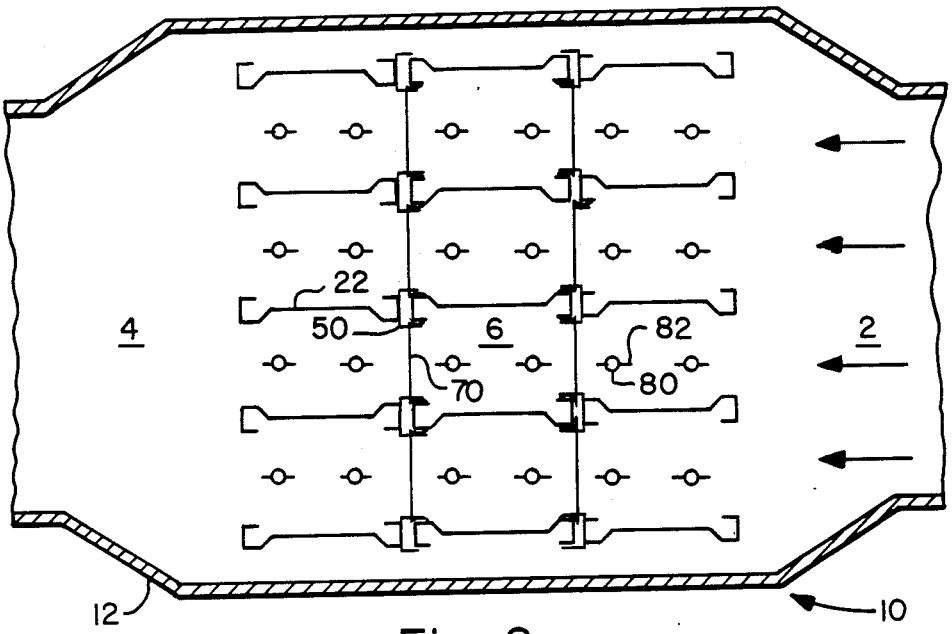
FIG. 2 is a sectional plan view taken along line 2—2 of FIG. 1 illustrating the spacers of the present invention in the electrostatic precipitator of FIG. 1.

Referring now to the drawing, and most particularly, to FIGS. 1 and 2 thereof, there is depicted therein an electrostatic precipitator 10 having a casing 12 with an inlet 2 and outlet 4 and precipitation chamber 6 disposed therebetween. The particulate laden flue gas to be cleaned passes through the housing 12 of the precipitator 10 passing from the gas inlet 2 through the precipitation chamber 6 and out the gas outlet 4 as clean, relatively particulate free gas.

A plurality of collecting electrode panels 20 are disposed in substantially parallel, spaced relationship in vertical planes within the precipitation chamber 6. Interdisposed in the spaces between the collecting electrode panels 20 are a plurality of discharge electrode subassemblies 32, which collectively form a discharge electrode assembly 30. Both the collecting panels 20 and the discharge electrode subassemblies 32 are aligned parallel to and extend in the direction of gas flow through the precipitation chamber 6 from the inlet 2 to the outlet 4 thereof.

Each of the individual discharge electrode subassemblies 32 is formed of a plurality of individual tubular discharge electrodes 80 disposed at spaced intervals to extend transversely between and be mounted to an upper frame member and a lower frame member of the subassemblies. The individual discharge electrode subassemblies are suspended from a support bar 34, which extends across the top of the precipitation chamber 6 and is mounted to the casing 12 through insulators 40. The individual discharge electrodes 80 are shown as tubular discharge electrodes having a plurality of corona discharge pins 82 extending outwardly from the tubular portion of the discharge electrode.

The discharge electrodes are shown in the drawing as being of this particular design, merely for purposes of illustration and not limitation. It is to be understood that the present invention contemplates utilizing any of a number of discharge electrode designs known in the art. For example, the discharge electrodes 80 could consist of a plurality of wires or rods, with or without corona discharge points disposed along their length. If the discharge electrodes are of tubular design, the tubular members could have a circular or elliptical cross-section or any other appropriate cross-section which would yield the desired electrostatic field configuration.

In operation, a particulate laden gas enters the precipitator casing 12 through the inlet 2 thereof and flows through the precipitation chamber 6 to the outlet 4 thereof. In traversing the precipitation chamber 6, the particulate laden gas flows between the spaced collecting electrode panels 20 and over the discharge electrode subassemblies 32 suspended therebetween. An electrical charge is applied to each of the discharge electrode subassemblies 32, so as to establish an electrostatic field extending between the discharge electrodes 80 and the grounded collecting electrode panels 20. As the particulates within the gas pass through the precipitation chamber 6, the particles are ionized and migrate to and deposit upon the collecting electrode plates 22 forming the grounded collecting electrode panel 20.

Figure 3:
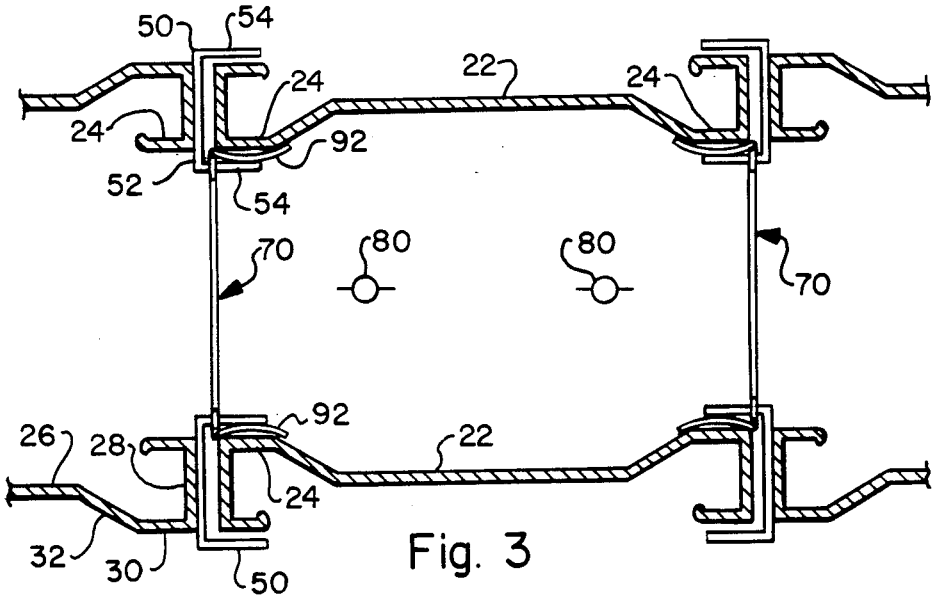
FIG. 3 is an enlarged detailed view illustrating the spacers installed between the collecting electrode plates of two neighboring collecting electrode panels in accordance with the present invention.

Each collecting electrode panel 20 is formed of a plurality of collecting electrode plates 22, which are disposed in successively aligned relationship beneath and suspended from an electrode support member or beam 14, which extends across the top of the precipitation chamber 6 and is adapted to be supported by the housing 12 of the precipitator 10. Each of the collecting electrode plates 22 is comprised of a pair of spaced end members 24 and a central web portion 26, extending between and interconnecting the spaced end members 24. Each end member 24 has an edge surface 28 extending substantially transverse into the central web portion 26 of the collecting electrode plate. As best seen in FIG. 3, each end member 24 of each of the collecting electrode plates 22 comprises an elongated beam of hook-shaped cross-section having a base portion 30 having an edge surface 28 and a stem portion 32 extending from the base portion 30 to connect to the central web portion 26 of the collecting electrode plate.

To assist in keeping the individual collecting electrode plates 22 forming a collecting electrode panel 20 in successive alignment in a common plane, alignment brackets 50 are mounted between the facing ends of successive plates 22 at at least one location along the vertical interface of successive plates. Each alignment bracket 50 comprises a generally U-shaped, rigid member having a base portion 52 and a pair of spaced legs 54 extending substantially perpendicularly outward from the base portion 52 of the bracket. The base portion 52 of each bracket 50 is rigidly secured, such as by welding or bolting, to the edge surface 28 of the end member 24 of one collecting electrode plate 22 with the spaced legs 54 of the bracket extending outwardly to loosely embrace the end member 24 of the next successive aligned collecting electrode plate 22 of the panel 20 in the cavity formed between the outwardly extending spaced legs 54 so as to entrap the neighboring plate and in effect "link" the plates 22 together to form a substantially planar segmented collecting electrode panel 20.

In accordance with the present invention, a plurality of spacers 70 are installed so as to extend transversely between adjacent collecting electrode panels 20, as best seen in FIGS. 2 and 3, to provide structural rigidity to the assembly of collecting electrode panels thereby maintaining the desired uniform spacing between and the parallel relationship of neighboring collecting electrode panels 20. Each spacer 70 is adapted to engage a leg 54 of an alignment bracket 50. Therefore, each spacer is positioned to extend along the interface between successively aligned collecting electrode plates 22 of adjacent collecting electrode panels 20.

Figure 5:
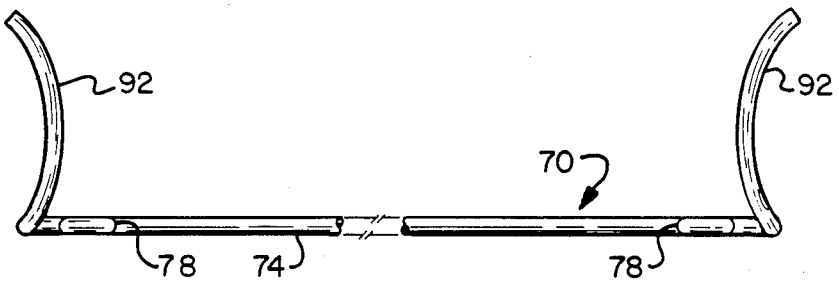
FIG. 5 is a plan view of the spacer of the present invention taken along line 5—5 of FIG. 4.
Figure 4:
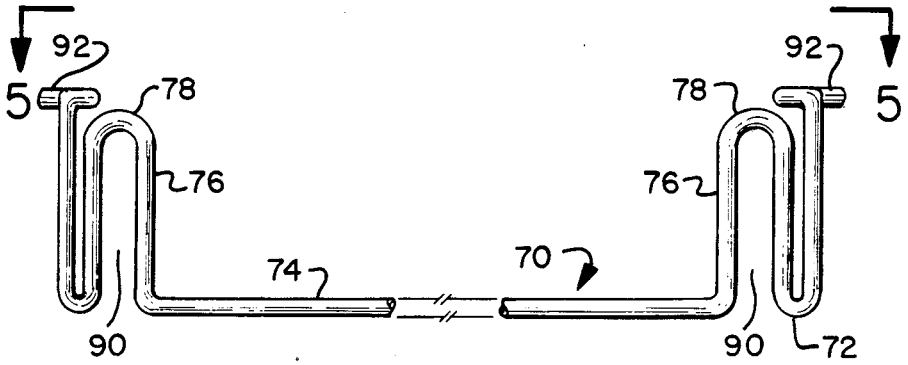
FIG. 4 is a side elevational view of the spacer of the present invention.

As best seen in FIG. 4 and 5, the spacer 70 of Applicant's invention is a one-piece device comprising a pair of spaced resilient end portions 72, a rigid longitudinally extending central portion 74 interconnecting the spaced end portions 72, and clip means 76 associated with each end portion 72. The clip means 76 is adapted to receive and engage the leg 54 of the alignment bracket 50 and the surface of the end member 24 of the collecting electrode plate 22 entrapped within the cavity of the leg 54 whereby the clip means 76 engaging the leg 54 of the alignment bracket 50 is held in place.

In the preferred embodiment of the spacer 70 of the present invention illustrated in the drawing, the spacer is formed of a cylindrical rod. The resilient end portions 72 are formed by folding and bending the end portions of the rod extending beyond the straight central portion 74 of the rod. The ends 72 of the rod are bent to provide a vertical fold 78 defining a slot 90 for receiving a leg 54 of an alignment bracket 50. Preferably, the ends 72 are folded once more in the opposite direction to provide a N-shaped accordian-like structure to the ends of the rod to impart resiliency to ends. With this accordian-like structure, the inner fold defines the slot 90 for receiving the leg 54 of the alignment bracket 50, while the outer fold provides a spring action member which establishes a locking force between the leg 54 of the bracket 50 and the end member 24 of the collecting electrode plate 22 engaged by the bracket 50. To further enhance the spring action of the outer portion of the ends 72, the outermost portion of the rod end is preferably bent to a form substantially horizontal tail 92 extending outwardly from the plane of the fold in a arcuate, concave form in a second plane substantially orthogonal to the plane of the folds.

The spacers of the present invention are readily installable to an existing electrostatic precipitator without cutting, drilling, punching, welding, bolting or other laborious procedure. The spacer is merely inserted between the discharge electrode members, turned to extend transversely between the collecting electrode panels, and dropped into position with the slots 90 sliding downwardly over and engaging the legs 54 of preexisting alignment brackets 50 mounted at oppositely disposed locations on the parallel collecting electrode panels. The installation procedure is simple and does not involve the moving of any discharge electrodes or collecting electrode panels, nor the assembly of special access scaffolding. Therefore, the installation cost and precipitator downtime are reduced over that required for any prior art spacer systems.

Although described and illustrated herein with reference to the preferred embodiment shown in the drawings which represents the best mode presently contemplated for carrying out the present invention, it is to be understood that many variations of the depicted embodiment may be envisioned by those skilled in the art without departing from the basic concept of the present invention. For example, the configuration of the spacer may not be that of a cylindrical rod. For instance, the spacer may have the configuration of a flat bar as opposed to a rod. Accordingly, it is intended that the present invention be interrupted in spirit and in scope as defined by the claims appended hereto.

I claim:

1. A spacer for maintaining a pair of adjacent laterally spaced collecting electrode panels in parallel relationship in spaced vertically extending planes within the precipitation chamber of an electrostatic precipitator of the type wherein each collecting electrode panel is formed of a plurality if vertically extending collecting electrode plates sucessively aligned in end to end relationship with a plurality of alignment brackets disposed at the interface between successsively aligned collecting electrode plates for maintaining successive collecting electrode plates in alignment, said spacer comprising a one-piece elongated rod-like member having a rigid straight central portion extending along a longitudinal axis, and spaced end portions disposed outwardly from said central portion at the opposite extremities thereof, each of said end portions formed by folding and bending a length of an end of said elongated rod-like member to form clip means integral therewith comprising an accordian-like folded structure having a first fold extending in a plane through the axis of the central portion of the rod and defining a slot for receiving a portion of an alignment bracket mounted to a collecting electrode plate and having a second fold extending in the plane of the first fold and disposed outwardly of the first fold, said second fold having a tail portion extending outwardly from the plane of the first and second folds along an arcuate path substantially in a second plane substantially orthogonal to the plane of the first and second folds.

2. An electrostatic precipitator comprising:

a. a housing defining a precipitation chamber therein and having a dirty gas inlet and a clean gas outlet for conveying a flow of gas to be cleaned through the precipitation chamber;

b. at least a pair of laterally adjacent collecting electrode panels disposed within the precipitation chamber in laterally spaced vertical planes aligned parallel to the direction of gas flow therethrough, each of said collecting electrode panels being formed of a plurality of vertically extending collecting electrode plates successively aligned in end to end relationship with at least one alignment bracket disposed at the interface between each set of sucessively aligned collecting electrode plates for maintaining successive collecting electrode plates within each collecting electrode panel in alignment; and c. spacer means disposed so as to extend transversely between said pair of adjacent collecting electrode panels along a longitudinal axis through the interface between successively aligned collecting electrode plates of said pair of adjacent collecting electrode panels, said spacer means comprising an integral one-piece elongated member having a rigid central portion extending along said longitudinal axis and space end portions disposed outwardly from said central portion at the opposite extremities thereof, said end portions forming integral clip means adapted to engage a portion of an alignment bracket, one of said end portions engaging the alignment bracket of one of said pair of collecting electrode panels and the other of said end portions engaging the alignment bracket of the other of said pair of collecting electrode panels.

3. An electrostatic precipitator as recited in claim 2 wherein said one-piece spacer means comprises an elongated cylindrical rod having a rigid straight central portion extending along said longitudinal axis, and space end portions disposed outwardly from said central portion at the opposite extremities thereof, each of said end portions formed by folding and bending a length of an end of said elongated cylindrical rod to provide said integral clip means, said integral clip means comprising an accordin-like folded structure having a first fold extending in a plane through the axis of the central portion of the rod and defining a slot for receiving a portion of the aligment bracket of one of said pair of collecting electrode panels and having a second fold extending in the plane of the first fold and disposed outwardly of the first fold, said second fold having a tail portion extending outwardly from the plane of the first and second folds along an arcuate path substantially in a second plane substantially orthogonal to the plane of the first and second folds.

* * * * *